US007547198B2

(12) United States Patent
Saiki et al.

(10) Patent No.: US 7,547,198 B2
(45) Date of Patent: Jun. 16, 2009

(54) DOUBLE-HEADED PISTON TYPE COMPRESSOR

(75) Inventors: Akio Saiki, Kariya (JP); Masahiro Kawaguchi, Kariya (JP); Noriyuki Shintoku, Kariya (JP); Nobutoshi Banno, Kariya (JP); Jun Kondo, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 595 days.

(21) Appl. No.: 10/800,538

(22) Filed: Mar. 15, 2004

(65) Prior Publication Data

US 2004/0197202 A1 Oct. 7, 2004

(30) Foreign Application Priority Data

Mar. 18, 2003 (JP) ..... 2003-073464

(51) Int. Cl.
*F04B 1/12* (2006.01)
*F04B 27/08* (2006.01)

(52) U.S. Cl. ..... 417/269; 417/270; 91/499

(58) Field of Classification Search ..... 417/269, 417/270, 273; 91/499
See application file for complete search history.

(56) References Cited

U.S. PATENT DOCUMENTS 3,888,604 A * 6/1975 Oshima et al. ..... 417/269
4,127,363 A * 11/1978 Kato et al. ..... 417/269
4,846,631 A * 7/1989 Parrott ..... 417/273
5,181,834 A * 1/1993 Ikeda et al. ..... 417/269
6,558,133 B2 * 5/2003 Fukanuma et al. ..... 417/222.2
2004/0179948 A1 * 9/2004 Saiki et al. ..... 417/222.2

FOREIGN PATENT DOCUMENTS

| | | | |
|---|---|---|---|
| JP | 05-033765 | | 2/1993 |
| JP | 05-044640 | | 2/1993 |
| JP | 06-101641 | | 4/1994 |
| JP | 07-063165 | | 3/1995 |
| JP | 07-119631 | | 5/1995 |
| JP | 7063165 | * | 7/1995 |

* cited by examiner

*Primary Examiner*—Charles G Freay
*Assistant Examiner*—Peter J Bertheaud
(74) *Attorney, Agent, or Firm*—Knoble Yoshida & Dunleavy, LLC

(57) ABSTRACT

A double-headed piston type compressor forms a first compression chamber and a second compression chamber for compressing gas. The compressor has rotary shaft having an inner chamber that interconnects a suction chamber and the first and second compression chambers for introducing the gas into the first and second compression chambers. The compressor also has a partition wall that is located in the inner chamber for dividing the inner chamber into a first passage and a second passage. The first passage interconnects the suction chamber and the first compression chamber. The second passage interconnects the suction chamber and the second compression chamber.

19 Claims, 7 Drawing Sheets

DOUBLE-HEADED PISTON TYPE COMPRESSOR

BACKGROUND OF THE INVENTION

The present invention relates to a double-headed piston type compressor to compresses gas in front and rear compression chambers that are defined by double-headed pistons as the pistons reciprocate while a rotary shaft rotates.

Japanese Unexamined Patent Publication No. 7-63165 discloses a double-headed piston type compressor for a vehicle air-conditioner system. FIG. 8A illustrates a double-headed piston type compressor that is substantially identical to the one disclosed in the above Japanese reference. The double-headed piston type compressor includes a front cylinder head 101 and a rear cylinder head 102. A front discharge chamber 111A is formed in the front cylinder head 101. A suction chamber 112 and a rear discharge chamber 111B are formed in the rear cylinder head 102. The double-headed piston type compressor also includes a pair of cylinder blocks 104A and 104B that are respectively fixed to the cylinder heads 101 and 102. Thus, a housing of the above described double-headed piston type compressor includes the cylinder heads 101 and 102 and the cylinder blocks 104A and 104B. Incidentally, in FIG. 8A, the left and right sides of the double-headed type compressor corresponds to the front and rear sides thereof, respectively.

As shown in FIG. 8B, seal members 103 are placed between the front cylinder head 101 and the cylinder block 104A. Although not shown, the seal members 103 are similarly placed between the rear cylinder head 102 and the cylinder block 104B as in the front side.

Referring back to FIG. 8A, a front compression chamber 113A and a rear compression chamber 113B are respectively defined by a double-headed piston 114 in the front cylinder block 104A and the rear cylinder block 104B. A front rotary valve 117A is utilized as a front suction mechanism 115A for the front compression chamber 113A, and a rear rotary valve 117B is utilized as a rear suction mechanism 115B for the rear compression chamber 113B. The front and rear rotary valves 117A and 117B are provided on a rotary shaft 116. The front and rear rotary valves 117A and 117B respectively include front and rear suction communication passages 118A and 118B in the rotational direction. The front and the rear suction communication passages 118A and 118B periodically interconnect a shaft chamber 116*a* of the rotary shaft 116 and at least one of the front and rear compression chambers 113A and 113B in a suction process as the front and rear rotary valves 117A and 117B synchronously rotate with the rotary shaft 116.

The shaft chamber 116*a* is open to the suction chamber 112 at the rear end of the rotary shaft 116. Refrigerant is introduced from an external circuit into the suction chamber 112. The refrigerant in the suction chamber 112 is introduced into the rear compression chamber 113B through the shaft chamber 116*a* of the rotary shaft 116 and the rear rotary valve 117B. Similarly, the refrigerant in the suction chamber 112 is introduced into the front compression chamber 113A through the shaft chamber 116*a* and the front rotary valve 117A.

However, since the front and rear rotary valves 117A and 117B are respectively utilized as the front and rear suction mechanisms 115A and 115B in the double-headed piston type compressor, the refrigerant gas that has been introduced from an external refrigerant circuit into the suction chamber 112 in the rear cylinder head 102 is distributed to the rear suction communication passage 118B and the front suction communication passage 118A. A gas path from the suction chamber 112 to the front rotary valve 117A is longer than that to the rear rotary valve 117B. The gas paths to the front and rear rotary valves 117A and 117B share a common part 119 of the shaft chamber 116*a* from the suction chamber 112 to the front end of the rear suction communication passage 118B as indicated by a double-headed arrow in FIG. 8A.

Namely, referring to both FIGS. 8A and 8B, when the refrigerant gas flows from the suction chamber 112 toward the front and rear suction communication passages 118A and 118B in the front and rear rotary valves 117A and 117B, the refrigerant gas tends to be introduced more into the rear suction communication passage 118B in the rear rotary valve 117B than the front suction passage 118A in the front rotary valve 117A. Thus, the front communication chamber 113A lacks for the refrigerant gas so that compression ratio is relatively large. Thereby, temperature of the discharged refrigerant gas in the front discharge chamber 111A rises substantially higher in comparison to that in the rear discharge chamber 111B. Accordingly, outer circumference of seal portions 103*a* of the seal members 103 that seal the front discharge chamber 111A and the front compression chamber 113A from the outside of the compressor are under thermally adverse conditions in comparison to the seal members 103 seal the rear discharge chamber 111B and the rear compression chamber 113B.

SUMMARY OF THE INVENTION

The present invention provides a double-headed piston type compressor that introduces a sufficient amount of gas into a front compression chamber.

In accordance with the present invention, a double-headed piston type compressor includes a housing having a front housing and a rear housing and forming a plurality of first cylinder bores, a plurality of second cylinder bores and a suction chamber formed in the rear housing being located rearward of the second cylinder bores; a rotary shaft rotatably supported by the housing and having an inner chamber along the rotational axis, a first suction communication passage and a second suction communication passage, the inner chamber communicating with the suction chamber near a front end of the rear housing, wherein the first cylinder bores and the second cylinder bores are arranged around the rotational axis of the rotary shaft; a plurality of double-headed pistons connected to the rotary shaft, each of the pistons being accommodated in the first cylinder bore and the associated second cylinder bore to respectively define a first compression chamber and a second compression chamber, each of the pistons reciprocating for compressing gas in the first compression chambers and the second compression chambers as the rotary shaft rotates; a partition wall located in the inner chamber along the rotational axis of the rotary shaft for dividing the inner chamber into a first passage and a second passage, the first passage interconnecting the suction chamber and the first suction communication passage, the second passage interconnecting the suction chamber and the second suction communication passage, wherein the partition wall has a rear end portion that is closer to the suction chamber than a front end of the second communication passage; the gas in the first passage and the second passage maintaining substantially the same pressure as in the suction chamber, wherein the front end portion of the partition wall is fixed to an inner circumferential surface of the inner chamber so that a front end of the first passage is located frontward of a front end of the second passage and so that the first passage and the second passage are separately defined from each other; a first suction valve mechanism rotatably provided on the rotary shaft near a rear end of the front housing for introducing the gas from the suction chamber to the first compression chambers through the first passage, the first suction valve mechanism including a first rotary valve that has the first suction communication passage for sequentially interconnecting the first passage and the first compression chambers in a suction process as the first suction valve mechanism rotates synchronously with the rotary shaft; and a second suction valve mechanism rotatably provided on the rotary shaft near the front end of the rear housing for introducing the gas from the suction chamber to the second compression chambers through the second passage, the second valve mechanism including a second rotary valve that has the second suction communication passage for sequentially interconnecting the second passage and the second compression chambers in the suction process as the second suction valve mechanism rotates synchronously with the rotary shaft.

The present invention also provides a double-headed piston type compressor including a housing having a front housing and a rear housing and forming a plurality of first cylinder bores, a plurality of second cylinder bores and a suction chamber formed in the rear housing, the rear housing being located rearward of the second cylinder bores; a rotary shaft rotatably supported by the housing and having a rotational axis, the shaft having an inner chamber along the rotational axis, a first suction communication passage and a second suction communication passage. the inner chamber communicating with the suction chamber near a front end of the rear housing, wherein the first cylinder bores and the second cylinder bores are arranged around the rotational axis of the rotary shaft; a plurality of double-headed pistons connected to the rotary shaft, each of the pistons being accommodated in the first cylinder bore and the associated second cylinder bore to respectively define a first compression chamber and a second compression chamber, each of the pistons reciprocating for compressing gas in the first cornpression chambers and the second compression chambers as the rotary shaft rotates; a partition wall located in the inner chamber along the rotational axis of the rotary shaft for dividing the inner chamber into a first passage and a second passage, the first passage interconnecting the suction chamber and the first suction communication passage, the second passage interconnecting the suction chamber and the second suction communication passage, wherein the partition wall has a rear end poition that is closer to the suction chamber than a front end of the second suction communication passage: wherein a cross sectional area of the first passage is larger than a cross sectional area of the second passage: a first suction valve mechanism rotatably provided on the rotary shaft near a rear end o.f the front housing forintroducing the gas from the suction chamber to the first compression chambers through the first passage, the first suction valve mechanism including a first rotary valve that has the first suction communication passage for sequentially interconnecting the first passage and the first compression chambers in a suction process as the first suction valve mechanism rotates synchronously with the rotary shaft; and a second suction valve mechanism rotatably provided on the rotary shaft near the front end of the rear housing for introducing the gas from the suction chamber to the second compression chambers through the second passage, the second valve mechanism including a second rotary valve that has the second suction communication passage for seciuentially interconnecting the second passane and the second compression chambers in the suction process as the second suction valve mechanism rotates synchronously with the rotary shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

The present invention is applied to a double-headed piston type fixed displacement compressor (hereinafter the compressor) that constitutes a part of a refrigerant circulation circuit in a vehicle air-conditioner system. A preferred embodiment according to the present invention will be described in reference to FIGS. 1A and 1B. The left side and the right side of FIG. 1A respectively correspond to the front side and the rear side of the compressor.

Figure 1B:
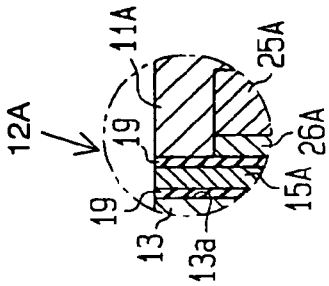
FIG. 1B is an enlarged cross-sectional view of a double-headed piston type compressor showing seal members on a front side according to the preferred embodiment.

A housing of the compressor includes a pair of a front cylinder block 11A and a rear cylinder block 11B, a front housing 13 and a rear housing 14. The rear housing 14 is also called a cylinder head that is arranged on the back side of compression chambers 40B. The front cylinder block 11A is fixed to the rear cylinder block 11B. The front housing 13 is fixed to the front cylinder block 11A via a front valve port assembly 12A. The rear housing 14 is fixed to the rear cylinder block 11B via a rear valve port assembly 12B. As illustrated in FIG. 1B, the front valve port assembly 12A includes a retainer plate 15A, a valve plate 26A and a port plate 25A arranged in this order from the front housing 13. Similarly, the rear valve port assembly 12B includes a retainer plate 15B, a valve plate 26B and a port plate 25B arranged in this order from the rear housing 14.

A front discharge chamber 21A is defined in the front housing 13. Namely, the front discharge chamber 21A is defined in such a manner that a front surface 18A of the retainer plate 15A contacts a rear end surface 13*a* of the front housing 13 as shown in FIG. 1B. Also, a rear discharge chamber 21B is defined in the rear housing 14. Namely, the rear discharge chamber 21B is defined in such a manner that a rear surface 18B of the retainer plate 15B contacts a front end surface 14*a* of the rear housing 14. A suction chamber 22 is defined between the rear housing 14 and the rear cylinder block 11B through the rear valve port assembly 12B.

As shown in FIG. 1B, a seal member 19 made of elastomer is provided on the front and rear surfaces of the retainer plate 15A for sealing clearance between the front retainer plate 15A and the front cylinder block 11A or the front housing 13. Although not shown, the seal member 19 made of elastomer is similarly respectively provided on the front and rear surfaces of the retainer plate 15B for sealing clearance between the rear retainer plate 15B and the rear cylinder block 11B or the rear housing 14.

Referring back to FIG. 1A, discharge ports 27A and 27B are respectively formed in the port plates 25A and 25B. Discharge valves 28A and 28B are respectively formed in the valve plates 26A and 26B. The discharge valves 28A and 28B respectively open and close the corresponding discharge ports 27A and 27B. Retainers 29A and 29B are respectively formed in the retainer plates 15A and 15B to regulate the opening degrees of the discharge valves 28A and 28B.

A rotary shaft 31 is rotatably supported in the cylinder blocks 11A and 11B. The rotary shaft 31 is inserted into a front accommodation hole 32A and a rear accommodation hole 32B that respectively extend through the center of the cylinder blocks 11A and 11B. Namely, the rotary shaft 31 is slidably supported by the cylinder blocks 11A and 11B in the front and rear accommodation holes 32A and 32B. A through hole 33 extends through the front valve port assembly 12A and the front housing 13. The front end portion of the rotary shaft 31 protrudes to the outside of the front housing 13 through the through hole 33 and is operationally connected to an engine Eg for being driven by the engine Eg of a vehicle. A shaft seal member 34 is arranged between the front housing 13 and the rotary shaft 31 in the through hole 33.

The cylinder blocks 11A and 11B define a crank chamber 36. A cam body 35 is provided on an outer circumferential surface 31*a* of the rotary shaft 31 in the crank chamber 36. The cam body 35 includes an annular base portion 35*a* and a swash plate portion 35*b*. The base portion 35*a* is secured to the outer circumferential surface 31*a* of the rotary shaft 31. The swash plate portion 35*b* is formed integrally with the base plate 35*a*. A front thrust bearing 37A is placed between the front surface of the base portion 35*a* of the cam body 35 and the opposing rear end surface of the front cylinder block 11A. A rear thrust bearing 37B is placed between the rear surface of the base portion 35*a* of the cam body 35 and the opposing front end surface of the rear cylinder block 11B. Since the base portion 35*a* of the cam body 35 is sandwiched by a pair of the thrust bearings 37A and 37B, the sliding movement of the rotary shaft 31 along a rotational axis L of the rotary shaft 31 is regulated.

Figure 1A:
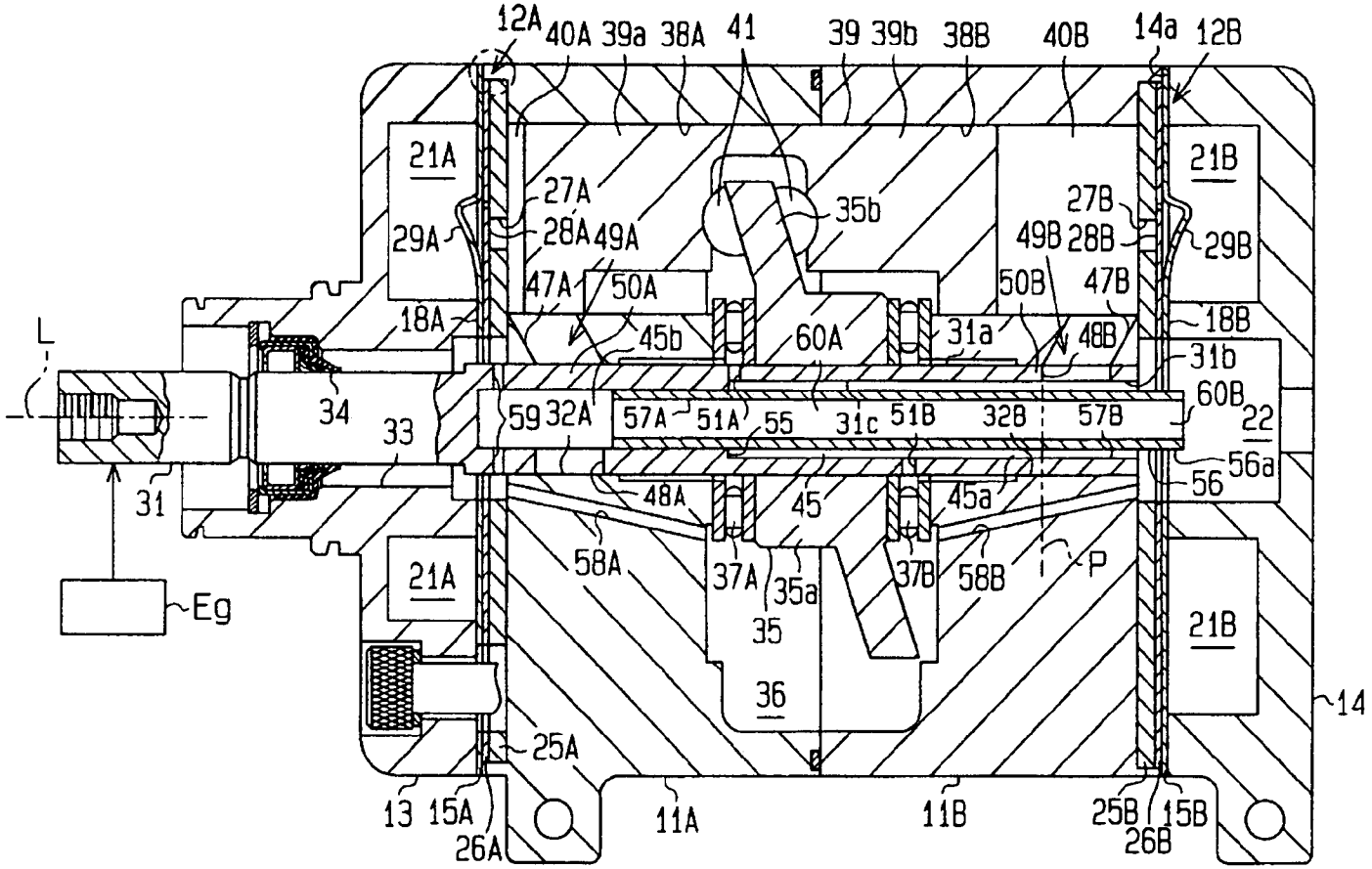
FIG. 1A is a longitudinal cross-sectional view of a double-headed piston type compressor according to a preferred embodiment.

A plurality of front cylinder bores 38A and a plurality of rear cylinder bores 38B are respectively formed in the cylinder blocks 11A and 11B and are arranged around the axial L of the rotary shaft 31. One of the front cylinder bores 38A and one of the rear cylinders 38B are shown in FIG. 1A. The central axis of the front cylinder bore 38A is aligned with that of the associated rear cylinder bore 38B so that the front cylinder bore 38A is paired with the rear cylinder bore 38B. A front head 39*a* of a double-headed piston 39 (hereinafter the piston) is inserted into each of the front cylinder bores 38A, and an associated rear head 39*b* of the piston 39 is inserted into the associated rear cylinder bore 38B. The piston 39 defines a front compression chamber 40A and a rear compression chamber 40B in the cylinder bores 38A and 38B.

The piston 39 is engaged with the swash plate portion 35*b* of the cam body 35 through a pair of shoes 41. As the cam body 35 rotates integrally with the rotary shaft 31, the rotation of the cam body 35 is transmitted to the piston 39 through the shoes 41 to reciprocate the piston 39 in the cylinder bores 38A and 38B frontward and backward. The cam body 35 and the shoes 41 constitute a crank mechanism that converts the rotation of the rotary shaft 31 into the reciprocating movement of the piston 39.

A plurality of front introduction passages 47A is formed in the front cylinder block 11A to interconnect each of the front cylinder bores 38A and the front accommodation hole 32A of the front cylinder block 11A. A plurality of rear introduction passage 47B is formed in the rear cylinder block 11B to interconnect each of the rear cylinder bores 38B and the rear accommodation hole 32B of the rear cylinder block 11B. A shaft chamber 45 is formed in the rotary shaft 31 and extends along the rotational axis L of the rotary shaft 31. The shaft chamber 45 communicates with the suction chamber 22 through an opening 31*b* that is formed at the rear end of the rotary shaft 31. The shaft chamber 45 includes a large-diameter cylindrical chamber 45*a* on the rear side and a small-diameter cylindrical chamber 45*b* on the front side whose diameter is smaller than that of the large-diameter chamber 45*a*. A step is formed by an annular wall surface 55 at a connecting part between the large-diameter chamber 45*a* and the small-diameter chamber 45*b* on an inner circumferential surface 31*c* of the rotary shaft 31, which defines the shaft chamber 45. The wall surface 55 faces the rear side.

A cylindrical partition wall 56 is fixedly inserted in the rotary shaft 31. The front end portion of the partition wall 56 is fixedly press-fitted into the small-diameter chamber 45*b*. A rear end portion 56*a* of the partition wall 56 protrudes from the shaft chamber 45 into the suction chamber 22. The cylindrical inner space of the partition wall 56 includes a partition wall front inner space 60A that is located in the shaft chamber 45 and a partition wall rear inner space 60B that is located in the suction chamber 22. The partition wall rear inner space 60B partially constitutes the suction chamber 22.

The partition wall 56 divides the shaft chamber 45 into an inner partition wall space and an outer partition wall space. The inner partition wall space includes the small-diameter chamber 45*b* and the partition wall front inner space 60A of the partition wall 56. The outer partition wall space is defined between outside the partition wall 56 and inside the shaft chamber 45 that is in the rearward of the wall surface 55. A front suction communication passage 48A interconnects the inner circumferential surface 31*c* of the rotary shaft 31 corresponding to the small-diameter chamber 45*b* and the outer circumferential surface 31*a* of the rotary shaft 31. The inner partition wall space communicates with the outside of the rotary shaft 31 through the front suction communication passage 48A. Accordingly, the inner partition wall space functions as a first passage 57A that interconnects the partition wall rear inner space 60B that is a part of the suction chamber 22 and the front suction communication passage 48A.

A rear suction communication passage 48B interconnects the inner circumferential surface 31*c* of the rotary shaft 31 corresponding to the large-diameter chamber 45*a* and the outer circumferential surface 31*a* of the rotary shaft 31. The outer partition wall space, which is outside the partition wall 56, communicates with the outside of the rotary shaft 31 through the rear suction communication passage 48B. Accordingly, the outer partition wall space functions as a second passage 57B that interconnects the suction chamber 22 and the rear suction communication passage 48B. As described above, the first and second passages 57A and 57B are separately defined in the shaft chamber 45.

As described above, the rear end portion 56*a* of the partition wall 56 protrudes from the shaft chamber 45 into the suction chamber 22. Thus, the rear end portion 56*a* is located in the rearward of a front end position P of the communication part or the border area between the rear suction communication passage 48B and the second passage 57B.

The cross section area of the first passage 57A is larger than that of the second passage 57B. The cross section area of the first passage 57A is defined as the cross section of the inner space of the partition wall 56 on the plane perpendicular to the rotational axis L. The cross section area of the second passage 57B is defined as the cross section of the annular region between the inner circumferential surface 31*c* of the rotary shaft 31 in the large-diameter chamber 45*a* and the outer circumferential surface of the partition wall 56 on the plane perpendicular to the rotational axis L.

The front suction communication passage 48A is formed to correspond to the front introduction passages 47A in the front cylinder block 11A. Also, the rear suction communication passage 48B is formed to correspond to the rear introduction passages 47B in the rear cylinder block 11B. As the rotary shaft 31 rotates, the front suction communication passage 48A intermittently interconnects the first passage 57A and the front introduction passages 47A. Similarly, as the rotary shaft 31 rotates, the rear suction communication passage 48B intermittently interconnects the second passage 57B and the rear introduction passages 47B. Accordingly, a part of the rotary shaft 31 surrounded the front accommodation hole 32A functions as a front rotary valve 50A that forms s a front suction valve mechanism 49A. The front rotary valve 50A includes the front suction communication passage 48A and is formed integrally with the rotary shaft 31. Also, a part of the rotary shaft 31 surrounded the rear accommodation hole 32B functions as a rear rotary valve 50B that forms a rear suction valve mechanism 49B. The rear rotary valve 50B includes the rear suction communication passage 48B and is formed integrally with the rotary shaft 31.

When the associated compression chambers 40A and 40B are in a suction process, the first and second passages 57A and 57B respectively communicate with the front and rear introduction holes 47A and 47B through the front and rear suction communication passages 48A and 48B. In this state, refrigerant gas in the suction chamber 22 is respectively introduced into the front and rear compression chambers 40A and 40B through the first and second passages 57A and 57B, the front and rear suction communication passages 48A and 48B, and the front and rear introduction passages 47A and 47B.

On the other hand, when the associated compression chambers 40A and 40B are in a compression process and or a discharge process, the communication between the first passage 57A and the front introduction passage 47A as well as the communication between the second passage 57B and the rear introduction passage 47B is blocked. In this state, the refrigerant gas is sequentially compressed in the front and rear compression chambers 40A and 40B, and the compressed refrigerant gas is respectively discharged from the front and rear discharge ports 27A and 27B into the front and rear discharge chambers 21A and 21B through the discharge valves 28A and 28B. The refrigerant gas that has been discharged into the front and rear discharge chambers 21A and 21B flows out to an external refrigerant circuit that is not shown. The external refrigerant circuit and the compressor are included in a refrigerant circulation circuit. The refrigerant gas that flows out to the external refrigerant circuit returns to the suction chamber 22. The refrigerant gas that circulates in the refrigerant circulation circuit includes lubricating oil, which is mist state in the refrigerant gas for lubricating parts inside the compressor.

Front and rear lubricating holes 51A and 51B extend through the rotary shaft 31 to interconnect the inner and outer circumferential surfaces 31*a* and 31*c* of the rotary shaft 31. The front and rear lubricating holes 51A and 51B are respectively formed at positions corresponding to the front and rear thrust bearings 37A and 37B. The lubricating oil in the shaft chamber 45 is respectively supplied to the front and rear thrust bearings 37A and 37B through the front and rear lubricating holes 51A and 51B due to centrifugal force according to the rotation of the drive shaft 31. In the present preferred embodiment, the front and rear lubricating holes 51A and 51B communicate with the second passage 57B. Thus, the lubricating oil in the second passage 57B is supplied to the front and rear thrust bearings 37A and 37B.

The front lubricating hole 51A is located near the wall surface 55 that is formed in the rotary shaft 31. The wall surface 55 is located in the front side of the front lubricating hole 51A. The wall surface 55 prevents the lubricating oil from flowing toward the front side along the inner circumferential surface 31*c* of the rotary shaft 31.

Meanwhile, while the refrigerant gas is compressed in the front and rear compression chambers 40A and 40B, the lubricating oil tends to accumulate in the crank chamber 36 due to leakage of the refrigerant gas from the compression chambers 40A and 40B through clearance between the piston 39 and the cylinder bore 38A or 38B. A front lubricating passage 58A is formed in the front cylinder block 11A to introduce the accumulated lubricating oil in the crank chamber 36 into the through hole 33, which accommodates the shaft seal member 34. Also, a rear lubricating passage 58B is formed in the rear cylinder block 11B to introduce the accumulated lubricating oil in the crank chamber 36 into the suction chamber 22.

The lubricating oil flow will be described after the lubricating oil is discharged from the crank chamber 36 to the through hole 33 and the suction chamber 22 through the front and rear lubricating passage 58A or 58B, respectively. A part of the lubricating oil introduced into the through hole 33 lubricates sliding portion between the shaft seal member 34 and the rotary shaft 31, and the rest of the lubricating oil is introduced into the small-diameter chamber 45*b* of the shaft chamber 45 through a through hole 59 that is formed in the rotary shaft 31. The lubricating oil in the small-diameter chamber 45*b* is further introduced into the front compression chambers 40A through the front suction valve mechanism 49A to lubricate the inside of the front cylinder bore 38A. Also, the lubricating oil in the suction chamber 22 is respectively introduced into the front and rear compression chambers 40A and 40B through the first and second passages 57A an 57B and the front and rear suction valve mechanisms 49A and 49B to lubricate the inside of the front and rear cylinder bores 38A and 38B.

According to the preferred embodiment, following advantageous effects are obtained.

(1) In the preferred embodiment, the first and second passages 57A and 57B are separately defined in the shaft chamber 45 in the rotary shaft 31. Thus, the refrigerant gas is separately introduced into the front suction communication passage 48A from the suction chamber 22 through the first passage 57A. The refrigerant gas is also separately introduced into the rear suction communication passage 48B from the suction chamber 22 through the second passage 57B. The rear end portion 56*a* of the partition wall 56 is located in the rearward of the front end position P of the communication part where the rear suction communication passage 48B and the second passage 57B communicate. In other words, the separation point of the first and second passages 57A and 57B for separately flowing the refrigerant gas flow from the suction chamber 22 to the front and rear compression chambers 40A and 40B is located in the rearward of the front end position P of the communication part. Thus, the refrigerant gas that is introduced from the suction chamber 22 toward the front suction communication passage 48A in the first passage 57A is prevented from being introduced into the rear suction communication passage 48B because the rear end portion 56*a* of the partition wall 56 is located in the rearward of the position P. In addition, the cross sectional area of the first passage 57A is consistently larger than that of the second passage 57B along the rotational axis L. Thereby, the refrigerant gas is sufficiently introduced into the front suction communication passage 48A, that is, the front compression chambers 40A. It substantially avoids the decrease in volumetric efficiency or the increase in compression ratio due to the decrease in the pressure of the front compression chambers 40A caused by an insufficient amount of the refrigerant gas introduced into the front compression chambers 40A. The increase in the compression ratio causes the temperature of the discharged refrigerant gas in the front discharge chamber 21A to rise. Namely, as a sufficient amount of the refrigerant gas is introduced into the front compression chambers 40A through the front suction communication passage 48A, the compression ratio does not relatively increase, and the temperature of the discharged refrigerant gas in the front discharge chamber 21A does not relatively rise. Therefore, thermal load is reduced on the seal members 19 placed between the front housing 13 and the front cylinder block 11A, and the life of the seal members 19 is extended.

As the refrigerant gas is sufficiently introduced into the front compression chambers 40A, the lubricating oil is also sufficiently introduced into the front compression chambers 40A. Thereby, the inside of the front cylinder bores 38A is efficiently lubricated, and heat due to sliding friction between the pistons 39 and the cylinder bores 38A is substantially prevented from being generated.

(2) The first passage 57A is longer than the second passage 57B. Thus, if the cross section of the first passage 57A were substantially the same as that of the second passage 57B, resistance of the refrigerant gas flow in the first passage 57A would be larger than that in the second passage 57B. Namely, based upon the above conditions, the amount of the refrigerant gas introduced into the front suction communication passage 48A of the front rotary valve 50A will be smaller than that into the rear suction communication passage 48B of the rear rotary valve 50B. However, since the cross section of the first passage 57A is larger than that of the second passage 57B in the present preferred embodiment, the resistance of the refrigerant gas flow in the first passage 57A and the second passage 57B is substantially equalized so that the amount of the refrigerant gas introduced into the front and rear compression chambers 40A and 40B is also substantially equalized.

(3) The rear end portion 56*a* of the cylindrical partition wall 56 protrudes from the shaft chamber 45 of the rotary shaft 31 into the suction chamber 22. Namely, the separation point of the first and second passages 57A and 57B that relates to the gas flow from the suction chamber 22 to the front and rear compression chambers 40A and 40B is located in the suction chamber 22. Thus, the refrigerant gas introduced from the suction chamber 22 into the first passage 57A is undisturbed by the gas flow from the suction chamber 22 toward the second passage 57B. Accordingly, the refrigerant gas is efficiently introduced from the suction chamber 22 into the first passage 57A.

(4) In the shaft chamber 45 of the rotary shaft 31, the cylindrical inner space of the cylindrical partition wall 56 forms the first passage 57A, and the outside surface of the cylindrical partition wall 56 partially forms the second passage 57B. Thereby, the first passage 57A is surrounded by the second passage 57B in the rotary shaft 31. The refrigerant gas introduced into the front compression chambers 40A is less thermally affected by the temperature of the outside of the rotary shaft 31 than the refrigerant gas introduced into the rear compression chambers 40B while the refrigerant gas moves in the first passage 57A. Therefore, the temperature of the refrigerant gas introduced into the front compression chambers 40A is prevented from rising so that the volumetric efficiency is not lowered.

The first passage 57A is longer than the second passage 57B. Thus, when the refrigerant gas moves in the first passage 57A, the refrigerant gas introduced into the front compression chambers 40A is exposed to the outside temperature of the rotary shaft 31 for a longer time than the refrigerant gas introduced into the compression chambers 40B. However, since the first passage 57A is surrounded by the second passage 57B, the refrigerant gas introduced into the front compression chambers 40A is less thermally affected by the outside temperature of the rotary shaft 31 than the refrigerant gas introduced into the compression chambers 40B. In this regard, the above structure of the present preferred embodiment is effective to prevent rising the internal refrigerant gas temperature in the first passage 57A.

Besides, the cylindrical partition wall 56 is inserted into the shaft chamber 45 of the rotary shaft 31 to divide the shaft chamber 45. Although the cross section of the first passage 57A is different from that of the second passage 57B, since the axis of the cylindrical partition wall 56 coincides with the rotational axis L of the rotary shaft 31 due to the same cylindrical structure, it is easy to appropriately maintain a rotational balance of the rotary shaft 31.

(5) In the rotary shaft 31, the front and rear lubricating holes 51A and 51B are respectively provided at the positions corresponding to the thrust bearings 37A and 37B for supplying the lubricating oil to the thrust bearings 37A and 37B. The front and rear lubricating holes 51A and 51B function as an entry route for the refrigerant gas from the crank chamber 36 to the shaft chamber 45 of the rotary shaft 31. Since the temperature of refrigerant gas tends to be higher in the crank chamber 36 than that in the suction chamber 22, the refrigerant gas in the crank chamber 36 enters to the rotary shaft 31 through the front and rear lubricating holes 51A and 51B. If the refrigerant gas in the crank chamber 36 hypothetically enters to the first passage 57A, the temperature of the refrigerant gas rises in the first passage 57A and the refrigerant gas is discharged from the front compression chambers 40A into the discharge chamber 21A at a relatively high temperature. In short, in this hypothetical case, it is disadvantageous to raise the temperature of the discharged refrigerant gas from the front compression chambers 40A.

However, in the present preferred embodiment, the front and rear lubricating holes 51A and 51B communicate with the second passage 57B. Thereby, the refrigerant gas in the crank chamber 36 is substantially prevented from entering into the first passage 57A. As a result, the refrigerant gas in the crank chamber 36 substantially fails to thermally affect the refrigerant gas in the first passage 57A, and the temperature of the refrigerant gas discharged from the front compression chambers 40A is prevented from excessively rising.

Also, since the front and rear lubricating holes 51A and 51B communicate with the second passage 57B and not with the first passage 57A, the lubricating oil in the first passage 57A is not applied to lubricate the front and rear thrust bearings 37A and 37B and is only introduced into the front compression chambers 40A through the front suction communication passage 48A. In comparison to an embodiment in which at least one of the front and rear lubricating holes 51A and 51B communicates with first passage 57A, the inside of the front cylinder bores 38A is efficiently lubricated.

(6) On the inner circumferential surface 31*c* of the rotary shaft 31, the wall surface 55 is provided near the front side of the front lubricating hole 51A for preventing the lubricating oil from flowing toward the front side along the inner circumferential surface 31*c* of the rotary shaft 31. Thereby, the lubricating oil sufficiently stays near the entry or the opening of the front lubricating hole 51A on the inner circumferential surface 31*c* of the rotary shaft 31. Accordingly, the lubricating oil is efficiently introduced into the front lubricating hole 51A, and the front thrust bearing 37A is efficiently lubricated.

(7) In the front cylinder block 11A, a discharging passage includes the front lubricating passage 58A, the through hole 33 and the through hole 59 and is provided for discharging the lubricating oil in the crank chamber 36 into the first passage 57A. Also, in the rear cylinder block 11B, the rear lubricating passage 58B is provided for discharging the lubricating oil in the crank chamber 36 into the suction chamber 22. Thereby, the inner surface of the front and rear cylinder bores 38A and 38B is efficiently lubricated. In addition to the lubricating oil introduced from the suction chamber 22 into the front cylinder bores 38A through the first passage 57A, the lubricating oil is introduced into the front cylinder bores 38A through the discharging passage including the front lubricating passage 58A, the through hole 33 and the through hole 59. Therefore, the lubrication of the inner surface of the front cylinder bores 38A is improved.

According to the present invention, the following alternative embodiments are also practiced. Although the wall surface 55 is provided at a position corresponding to the front lubricating hole 51A for preventing the lubricating oil from flowing toward the front side along the inner circumferential surface 31*c* of the rotary shaft 31 in the above-described preferred embodiment, an additional wall surface 62 is provided at a position corresponding to the rear lubricating hole 51B in a first alternative embodiment as shown in FIG. 2.

Figure 2:
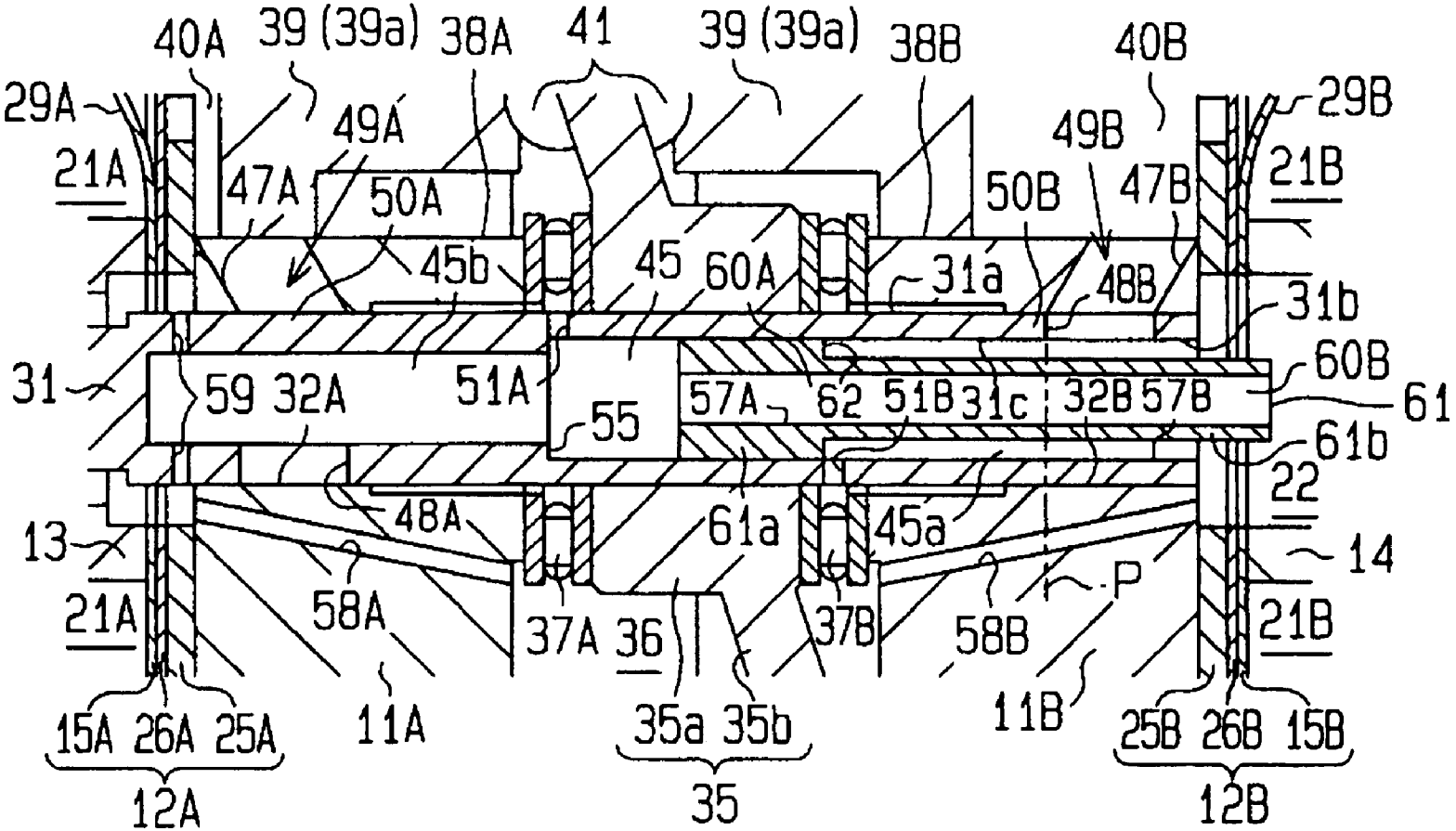
FIG. 2 is a partially enlarged cross-sectional view of the double-headed piston type compressor according to a first alternative embodiment.

Referring to FIG. 2, the first alternative embodiment is different that the cylindrical partition wall 56 in the above-described preferred embodiment of FIG. 1 is replaced by a cylindrical partition wall 61 that is fixedly inserted into the rotary shaft 31. The partition wall 61 includes a base portion 61*a* and a small-diameter portion 61*b* whose diameter is smaller than that of the base portion 61*a*. The base portion 61*a* and the small-diameter portion 61*b* are integrally formed. The partition wall 61 is fixed in such a manner that the base portion 61*a* is press-fitted into the large-diameter chamber 45*a*. A partition wall front inner space 60A including a frontward space of the base portion 61*a* in the shaft chamber 45 and an inside space of the partition wall 61 in the shaft chamber 45 forms a first passage 57A that interconnects the partition wall rear inner chamber 60B that is a part of the inner space in suction chamber 22 and a front suction communication passage 48A. An outside of the partition wall 61 in the shaft chamber 45 forms a second passage 57B that interconnects the suction chamber 22 and a rear suction communication passage 48B.

A step is formed by a wall surface 62 at a connecting part between the base portion 61*a* and the small-diameter portion 61*b*. The wall surface 62 has a function for preventing the lubricating oil from flowing toward the front side along the inner circumferential surface 31*c* of the rotary shaft 31. The wall surface 62 is located near the front side of the rear lubricating hole 51B. Thereby, the lubricating oil is efficiently introduced into the rear lubricating hole 51B, and the rear thrust bearing 37B is efficiently lubricated.

Also, in this structure, the front lubricating hole 51A communicates with the first passage 57A, and the rear lubricating hole 51B communicates with the second passage 57B. Accordingly, in comparison to another alternative embodiment to be disclosed with respect to FIG. 3 in which the front and rear lubricating holes 51A and 51B communicates with the first passage 57A, the refrigerant gas in the first passage 57A in the first alternative embodiment is less thermally affected by the refrigerant gas in the crank chamber 36.

Figure 3:
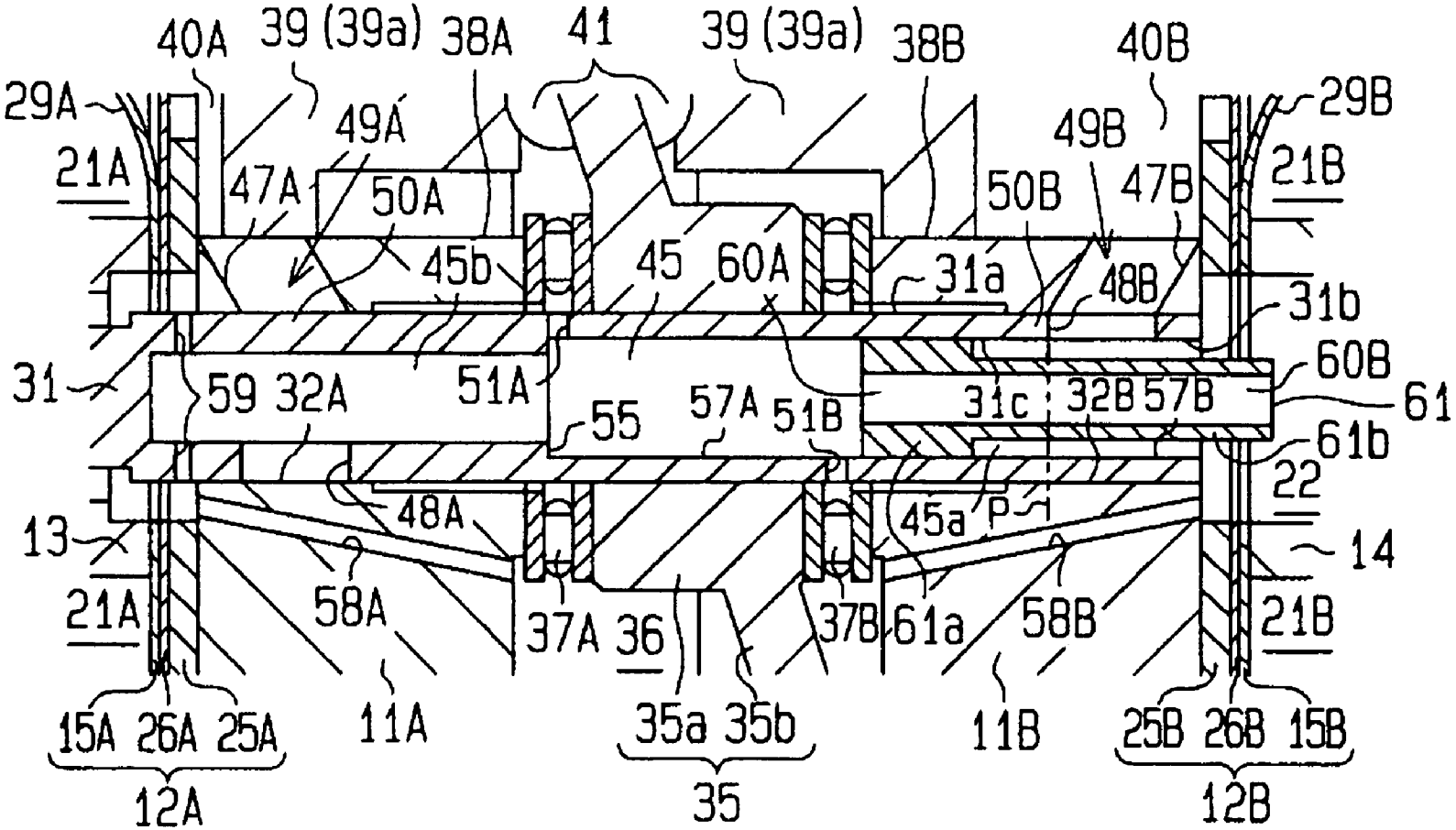
FIG. 3 is a partially enlarged cross-sectional view of a double-headed piston type compressor according to a second alternative embodiment.

In a second alternative embodiment, the front and rear lubricating holes 51A and 51B communicate with the first passage 57A as shown in FIG. 3. In the second alternative embodiment, the partition wall 61 in the first alternative embodiment as shown in FIG. 2 is moved toward the rear side. Namely, the front end surface of the base portion 61*a* of the partition wall 61 is located in the rearward of the rear lubricating hole 51B. Thereby, the front and rear lubricating holes 51A and 51B communicate with the first passage 57A. In the second alternative embodiment, the partition wall 61 is axially shorter than that as shown in FIG. 2. In comparison to an embodiment in which at least one of the front and rear lubricating holes 51A and 51B communicates with the second passage 57B, the refrigerant gas in the second passage 57B in the second alternative embodiment is less thermally affected by the refrigerant gas in the crank chamber 36.

Although a pair of the front and rear lubricating holes 51A and 51B are respectively provided at the positions corresponding to the front and rear thrust bearings 37A and 37B, a single lubricating hole is provided only at a position corresponding to one of the front and rear thrust bearings 37A and 37B or no lubricating hole is provided in a third alternative embodiment.

Figure 4:
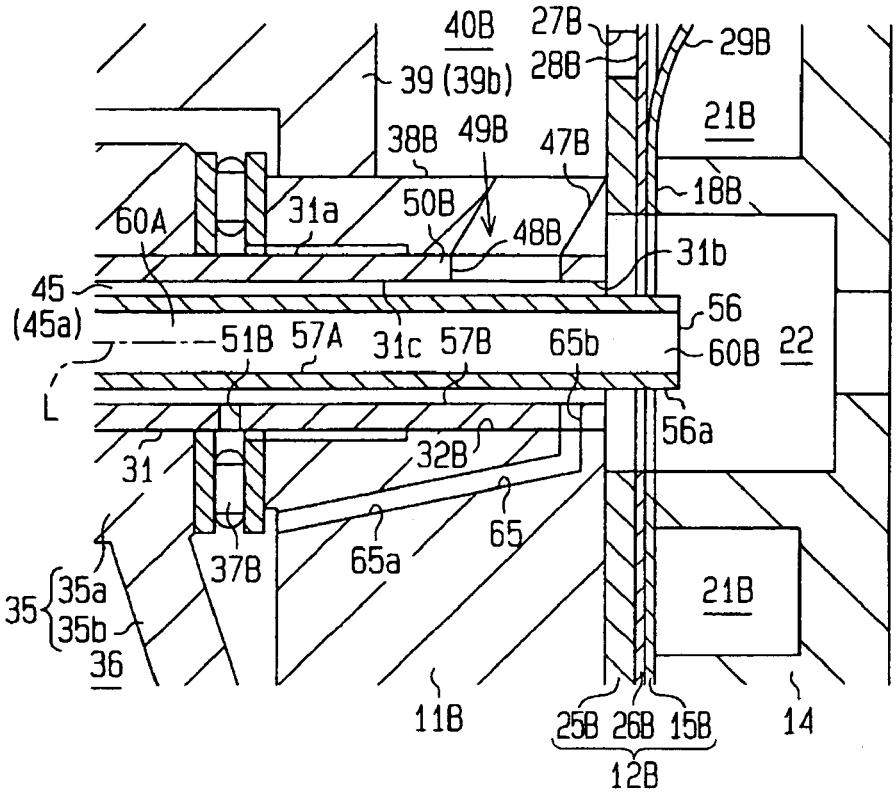
FIG. 4 is a partially enlarged cross-sectional view of a double-headed piston type compressor according to a fourth alternative embodiment.

As shown in FIG. 4, instead of the rear lubricating passage 58B in the above-described preferred embodiment of FIGS. 1, 2 or 3, an alternative rear lubricating passage 65 is further provided in a fourth alternative embodiment for discharging the lubricating oil in the crank chamber 36 directly into the second passage 57B without going through the suction chamber 22. The rear lubricating passage 65 includes an upstream lubricating passage 65*a* and a downstream lubricating passage 65*b*. The upstream lubricating passage 65*a* is provided in the rear cylinder block 11B to interconnect the crank chamber 36 and the rear accommodation hole 32B of the rear cylinder block 11B. One end of the upstream lubricating passage 65*a* is open on the inner circumferential surface of the rear accommodation hole 32B of the rear cylinder block 11B. In the rear end portion of the rotary shaft 31, the downstream lubricating passage 65*b* is provided for communicating with the shaft chamber 45 or the second passage 57B and is located in the rearward of the rear suction communication passage 48B. As the rotary shaft 31 rotates, the downstream lubricating passage 65*b* intermittently interconnects the shaft chamber 45 or the second passage 57B and the upstream lubricating passage 65*a*. Therefore, the crank chamber 36 intermittently communicates with the shaft chamber 45 through the rear lubricating passage 65 as the rotary shaft 31 rotates. Due to this communication, the lubricating oil in the crank chamber 36 is discharged directly into the shaft chamber 45 without going through the suction chamber 22. Thereby, in comparison to the above-described preferred embodiment in which the lubricating oil discharged from the crank chamber 36 into the suction chamber 22 through the rear lubricating passage 58B is sequentially introduced into the shaft chamber 45 or the first and second passages 57A and 57B as shown in FIGS. 1, 2, or 3, the lubricating oil is easily introduced into the second passage 57B. Thus, the inside of the rear cylinder bores 38B is efficiently lubricated.

Figure 5:
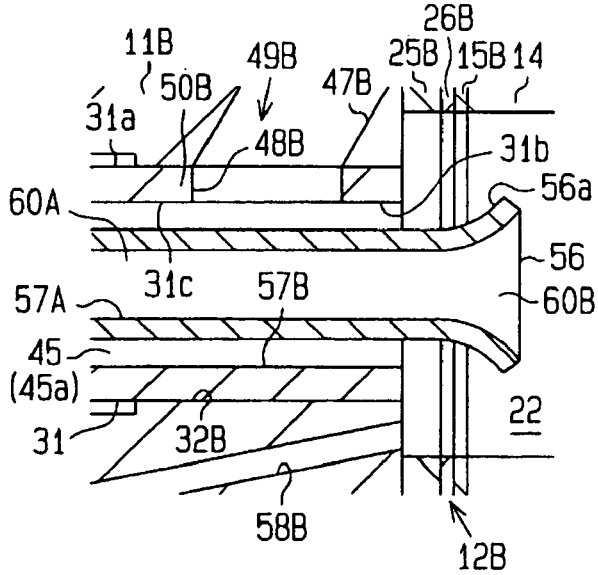
FIG. 5 is a partially enlarged cross-sectional view of a double-headed piston type compressor according to a fifth alternative embodiment.

In a fifth alternative embodiment, the opening of the rear end portion 56*a* of the partition wall 56 is widened toward the rear side. As shown in FIG. 5, the rear end portion 56*a* of the partition wall 56 has a funnel shape. Thereby, the refrigerant gas is more efficiently introduced into the first passage 57A. The above-described partition wall is not limited to the cylindrical partition wall 56 or 61. In a sixth alternative embodiment, the cross section of a partition wall has a polygonal shape instead of a circular shape.

Figure 6A:
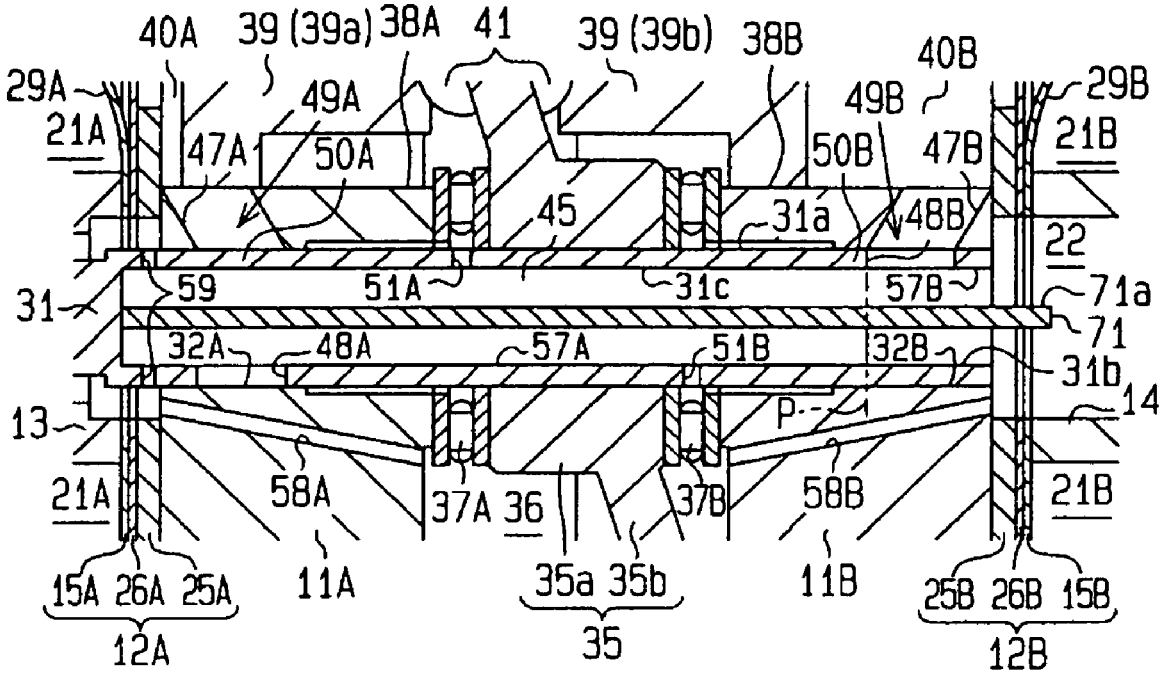
FIG. 6A is a partially enlarged cross-sectional view of a double-headed piston type compressor according to a seventh alternative embodiment.
Figure 6B:
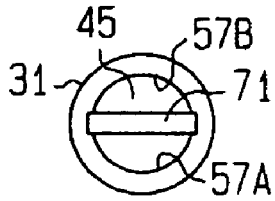
FIG. 6B is an end view of a rotary shaft according to the seventh alternative embodiment.

The cylindrical partition wall 56 or 61 divides the shaft chamber 45 of the rotary shaft 31 in the above-described preferred embodiment or the first through sixth alternative embodiments. However, as shown in FIGS. 6A and 6B, a planar partition wall 71 divides the shaft chamber 45 of the rotary shaft 31 in a seventh alternative embodiment. Namely, the partition wall 71 is press-fitted in the rotary shaft 31. The partition wall 71 divides the shaft chamber 45 of the rotary shaft 31 into two substantially equal spaces surrounded by the inner circumferential surface 31*c* of the rotary shaft 31 and the plate-like surface of the partition wall 71. One of the spaces forms a first passage 57A, and the other space forms a second passage 57B. A rear end portion 71*a* of the partition wall 71 protrudes from the shaft chamber 45 of the rotary shaft 31 into the suction chamber 22.

Figure 7:
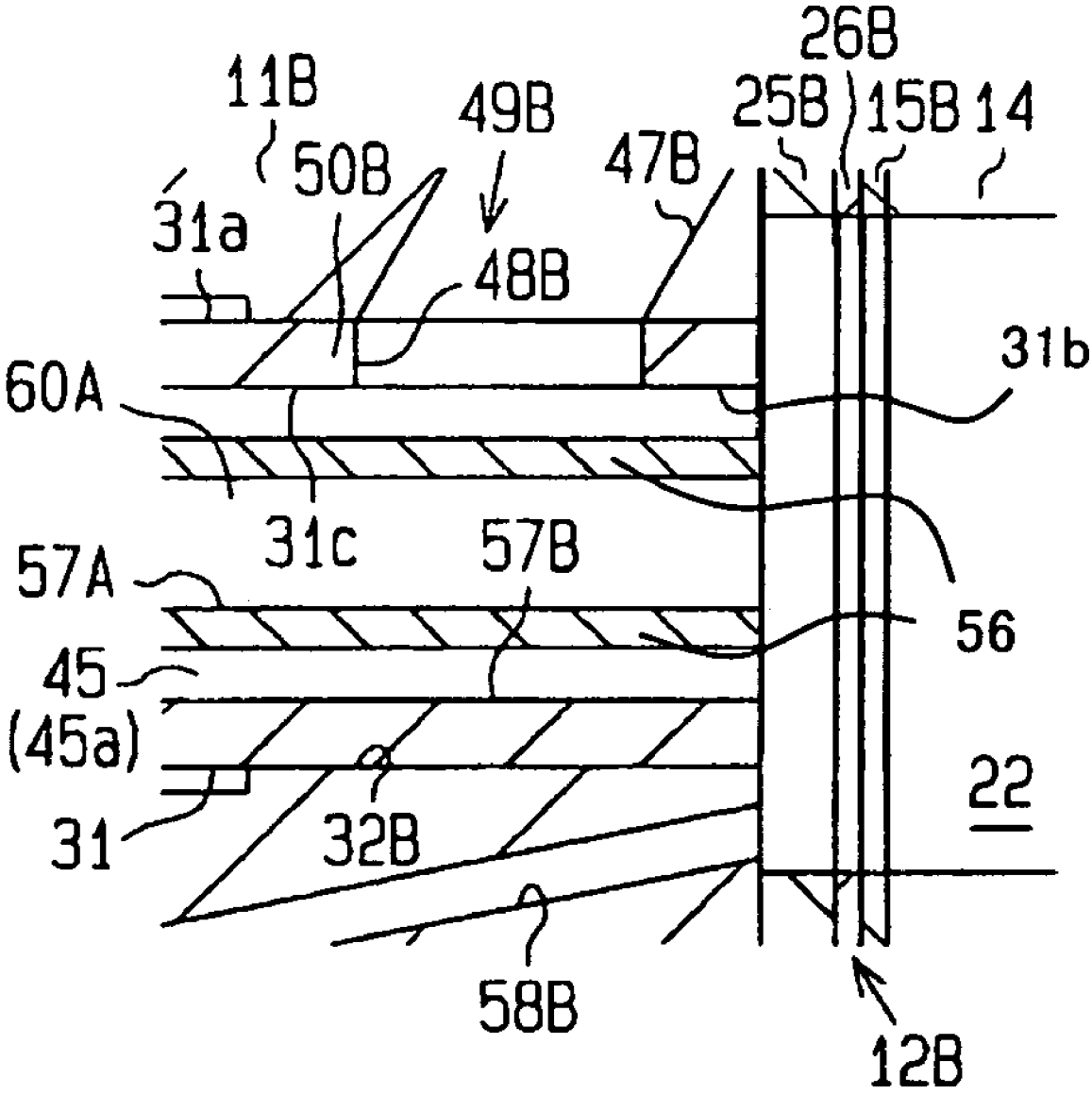
FIG. 7 is a partially enlarged cross-sectional view of a double-headed piston type compressor according to an eighth alternative embodiment.
Figure 8B:
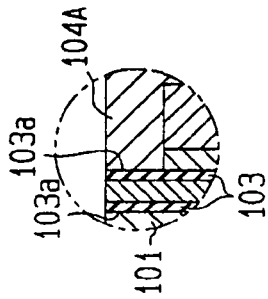
FIG. 8B (PRIOR ART)
FIG. 8B is an enlarged cross-sectional view of the double-headed piston type compressor showing seal members on a front side according to the prior art.
Figure 8A:
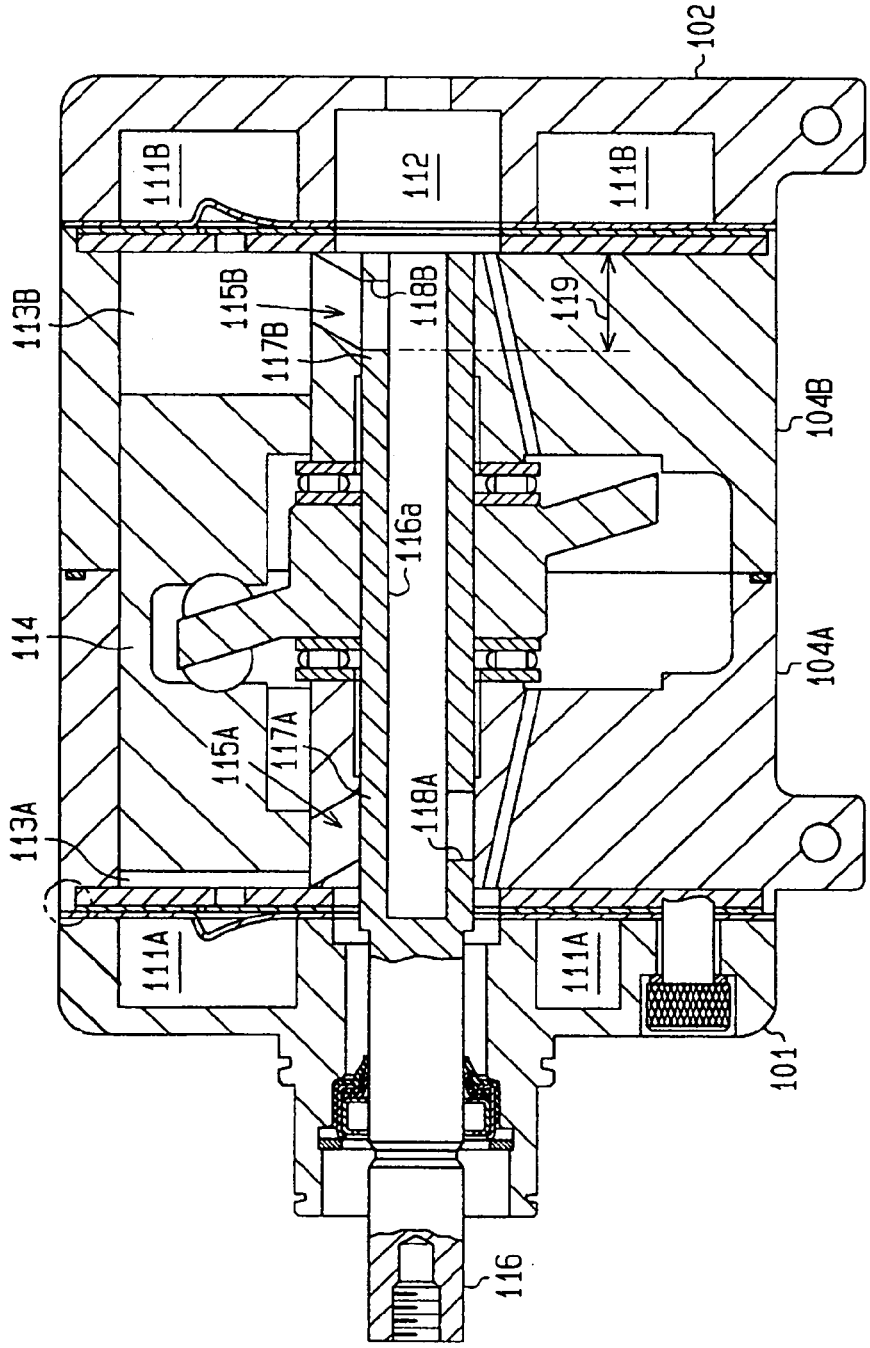
FIG. 8A (PRIOR ART)
FIG. 8A is a longitudinal cross-sectional view of a double-headed piston type compressor according to prior art.

In an eighth alternative embodiment, as shown in FIG. 7, the rear end portion of the partition wall 56 does not protrude from the shaft chamber 45 into the suction chamber 22. However, the rear end portion of the cylindrical partition wall 56 (the cylindrical partition wall 61, or the planar partition wall 71) that divides the shaft chamber 45 of the rotary shaft 31 is located in the rearward of the front end position P of the communication part that is located between the rear suction communication passage 48B of the rear rotary valve 50B and the second passage 57B.

The present examples and embodiments are to be considered as illustrative and not restrictive, and the invention is not to be limited to the details given herein but may be modified within the scope of the appended claims.

What is claimed is:

1. A double-headed piston type compressor comprising:

a housing having a front housing and a rear housing and forming a plurality of first cylinder bores, a plurality of second cylinder bores and a suction chamber formed in the rear housing, the rear housing being located rearward of the second cylinder bores;

a rotary shaft rotatably supported by the housing and having a rotational axis, the rotary shaft having an inner chamber along the rotational axis, a first suction communication passage and a second suction communication passage, the inner chamber communicating with the suction chamber near a front end of the rear housing, wherein the first cylinder bores and the second cylinder bores are arranged around the rotational axis of the rotary shaft;

a plurality of double-headed pistons connected to the rotary shaft, each of the pistons being accommodated in the first cylinder bore and the associated second cylinder bore to respectively define a first compression chamber and a second compression chamber, each of the pistons reciprocating for compressing gas in the first compression chambers and the second compression chambers as the rotary shaft rotates;

a partition wall located in the inner chamber along the rotational axis of the rotary shaft for dividing the inner chamber into a first passage and a second passage, the first passage interconnecting the suction chamber and the first suction communication passage, the second passage interconnecting the suction chamber and the second suction communication passage, wherein the partition wall has a rear end portion that is closer to the suction chamber than a front end of the second communication passage; the gas in the first passage and the second passage maintaining substantially the same pressure as in the suction chamber, wherein the front end portion of the partition wall is fixed to an inner circumferential surface of the inner chamber so that a front end of the first passage is located frontward of a front end of the second passage and so that the first passage and the second passage are separately defined from each other;

a first suction valve mechanism rotatably provided on the rotary shaft near a rear end of the front housing for introducing the gas from the suction chamber to the first compression chambers through the first passage, the first suction valve mechanism including a first rotary valve that has the first suction communication passage for sequentially interconnecting the first passage and the first compression chambers in a suction process as the first suction valve mechanism rotates synchronously with the rotary shaft; and a second suction valve mechanism rotatably provided on the rotary shaft near the front end of the rear housing for introducing the gas from the suction chamber to the second compression chambers through the second passage, the second valve mechanism including a second rotary valve that has the second suction communication passage for sequentially interconnecting the second passage and the second compression chambers in the suction process as the second suction valve mechanism rotates synchronously with the rotary shaft.

2. The double-headed piston type compressor according to claim 1, wherein the rear end portion of the partition wall is closer to the suction chamber than a front end of a communication part where the second passage communicates with the second suction communication passage.

3. The double-headed piston type compressor according to claim 2, wherein the rear end portion protrudes from the inner chamber into the suction chamber.

4. The double-headed piston type compressor according to claim 2, wherein the partition wall has a hollow cylindrical shape, an inside space of the partition wall forming the first passage, an outside space of the partition wall in the inner chamber forming the second passage.

5. The double-headed piston type compressor according to claim 4, wherein a cross-sectional area of the rear end portion is the largest in the partition wall.

6. The double-headed piston type compressor according to claim 4, wherein the rear end portion has a funnel shape.

7. The double-headed piston type compressor according to claim 4, wherein a cross section of the partition wall is circular.

8. The double-headed piston type compressor according to claim 1, wherein the gas contains lubricating oil for lubricating an inside of the compressor, the housing further comprising a pair of cylinder blocks that define a crank chamber for accommodating a crank mechanism that converts the rotation of the rotary shaft into the reciprocating movement of the piston, a pair of thrust bearings being located on an outer circumferential side of the rotary shaft along the rotational axis for restricting the rotary shaft to move along the rotational axis, a pair of lubricating holes extending through the rotary shaft for supplying the lubricating oil in the inner chamber to the thrust bearings, the lubricating holes being respectively located at positions corresponding to the thrust bearings, at least one of the lubricating holes communicating with the second passage.

9. The double-headed piston type compressor according to claim 8, wherein the rotary shaft has an inner surface for defining the inner chamber, a wall surface being provided near at least one of the lubricating holes in the inner chamber for preventing the lubricating oil from flowing along the inner surface of the rotary shaft.

10. The double-headed piston type compressor according to claim 8, wherein the other of the lubricating holes communicates with the first passage.

11. The double-headed piston type compressor according to claim 8, wherein a lubricating passage is formed in the housing for interconnecting the second passage and the crank chamber.

12. The double-headed piston type compressor according to claim 8, wherein a lubricating passage is formed in the housing for interconnecting the crank chamber and the first passage.

13. The double-headed piston type compressor according to claim 1, wherein the gas contains lubricating oil for lubricating an inside of the compressor, the housing further comprising a pair of cylinder blocks that define a crank chamber for accommodating a crank mechanism that converts the rotation of the rotary shaft into the reciprocating movement of the piston, a pair of thrust bearings being located on an outer circumferential side of the rotary shaft along the rotational axis for restricting the rotary shaft to move along the rotational axis, a pair of lubricating holes extending through the rotary shaft for supplying the lubricating oil in the inner chamber to the thrust bearings, the lubricating hole being respectively located at positions corresponding to the thrust bearings, the lubricating holes communicating with the first passage.

14. The double-headed piston type compressor according to claim 13, wherein the rotary shaft have an inner surface for defining the inner chamber, a wall surface being provided near at least one of the lubricating holes in the inner chamber for preventing the lubricating oil from flowing along the inner surface of the rotary shaft.

15. The double-headed piston type compressor according to claim 1, wherein a cross-sectional area of the first passage is larger than that of the second passage.

16. The double-headed piston type compressor according to claim 15, wherein the first passage is longer than the second passage.

17. The double-headed piston type compressor according to claim 1, wherein the partition wall has a planar shape.

18. The double-headed piston type compressor according to claim 1, wherein the inner chamber further comprises a large-diameter chamber and a small-diameter chamber.

19. A double-headed piston type compressor comprising:

a housing having a front housing and a rear housing and forming a plurality of first cylinder bores, a plurality of second cylinder bores and a suction chamber formed in the rear housing, the rear housing being located rearward of the second cylinder bores;

a rotary shaft rotatably supported by the housing and having a rotational axis, the rotary shaft having an inner chamber along the rotational axis, a first suction communication passage and a second suction communication passage, the inner chamber communicating with the suction chamber near a front end of the rear housing, wherein the first cylinder bores and the second cylinder bores are arranged around the rotational axis of the rotary shaft;

a plurality of double-headed pistons connected to the rotary shaft, each of the pistons being accommodated in the first cylinder bore and the associated second cylinder bore to respectively define a first compression chamber and a second compression chamber, each of the pistons reciprocating for compressing gas in the first compression chambers and the second compression chambers as the rotary shaft rotates;

a partition wall located in the inner chamber along the rotational axis of the rotary shaft for dividing the inner chamber into a first passage and a second passage, the first passage interconnecting the suction chamber and the first suction communication passage, the second passage interconnecting the suction chamber and the second suction communication passage, wherein the partition wall has a rear end portion that is closer to the suction chamber than a front end of the second suction communication passage; wherein a cross sectional area of the first passage is larger than a cross sectional area of the second passage;

a first suction valve mechanism rotatably provided on the rotary shaft near a rear end of the front housing for introducing the gas from the suction chamber to the first compression chambers through the first passage, the first suction valve mechanism including a first rotary valve that has the first suction communication passage for sequentially interconnecting the first passage and the first compression chambers in a suction process as the first suction valve mechanism rotates synchronously with the rotary shaft; and a second suction valve mechanism rotatably provided on the rotary shaft near the front end of the rear housing for introducing the gas from the suction chamber to the second compression chambers through the second passage, the second valve mechanism including a second rotary valve that has the second suction communication passage for sequentially interconnecting the second passage and the second compression chambers in the suction process as the second suction valve mechanism rotates synchronously with the rotary shaft.

* * * * *